US011832732B2

(12) United States Patent
Zhu et al.

(10) Patent No.: US 11,832,732 B2
(45) Date of Patent: Dec. 5, 2023

(54) FOLDABLE CHAIR FRAME

(71) Applicant: Zhejiang Sunshine Leisure Products Co., Ltd., Zhejiang (CN)

(72) Inventors: Xiaohui Zhu, Jinhua (CN); Xuefeng Zheng, Jinhua (CN)

(73) Assignee: Zhejiang Sunshine Leisure Products Co., Ltd., Jinhua (CN)

( * ) Notice: Subject to any disclaimer, the term of this patent is extended or adjusted under 35 U.S.C. 154(b) by 0 days.

(21) Appl. No.: 17/738,628

(22) Filed: May 6, 2022

(65) Prior Publication Data

US 2023/0023969 A1 Jan. 26, 2023

(30) Foreign Application Priority Data

Jul. 23, 2021 (CN) ..... 202121694205.6

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

FOREIGN PATENT DOCUMENTS

CN 209769717 U 12/2019
KR 101590505 B1 * 2/2016 ..... A47C 4/286

* cited by examiner

*Primary Examiner* — Anthony D Barfield
(74) *Attorney, Agent, or Firm* — Cooper Legal Group, LLC

(57) ABSTRACT

Embodiments provide a foldable chair frame, it includes an intermediate connecting device including a main body, a block, a first rotating piece and a second rotating piece, the block being provided in an inner cavity of the main body and capable to slide up and down along the inner cavity, the first rotating piece and the second rotating piece being pivoted in an opening groove of the main body and capable to rotate around a pivot point; a plurality of leg tubes pivoted to a periphery of the intermediate connecting device through the first rotating piece; a plurality of front seat tubes and backrest tubes pivoted to the periphery of the intermediate connecting device through the second rotating piece. The present disclosure connects each tube to the intermediate connecting device to make the foldable chair more stable.

20 Claims, 10 Drawing Sheets

FOLDABLE CHAIR FRAME

CROSS-REFERENCE TO RELATED APPLICATION

This application claims priority to Chinese Patent Application 202121694205.6, filed on Jul. 23, 2021, which is incorporated herein by reference.

TECHNICAL FIELD

The present disclosure relates to a technical field of foldable chair manufacturing, and in particular, to a foldable chair frame.

BACKGROUND

Similar foldable chairs in the prior art are provided with a large connector in the middle, and each leg tube is connected to the connector by an elastic rope. When folding the foldable chair, the tubes need to be pulled out from the connector one by one. When unfolding, the tubes also need to be put into the corresponding holes of the connector one by one, which is cumbersome and time-consuming.

For example, the patent No. ZL201920343182.0 discloses a foldable chair, including a foldable chair body and a seat pad, the foldable chair body includes: a main body seat; a support foot group including a plurality of supporting feet pivoted to the periphery of the main body seat, the supporting feet being provided with a receiving groove in the front; a plurality of telescopic positioning rods, the lower end of which is pivoted to the upper end of the receiving groove, the upper end of the telescopic positioning rod is connected with the seat pad, and can be stretched and supported; a locking mechanism including a positioning frame mounted in the inner cavity of the main body seat, an unlocking button inserted in the main body seat and fixed with the positioning frame, and a spring provided between the unlocking button and the main body seat. When the supporting feet are unfolded downward relative to the main body seat, the locking block on the outside of the positioning frame is clamped in the positioning groove on the upper end of the support foot, and is positioned under the elastic force of the spring. The technical solution solves the problem of cumbersome operation when folding and unfolding the foldable chair, and reduces the volume of the chair frame after folding, but the telescopic positioning rod is connected to the receiving groove of each corresponding leg tube, and is squeezed by two tube surfaces. To achieve stability, the load-bearing capacity of the method is relatively weak.

SUMMARY

The technical problem to be solved by the present disclosure is to provide a foldable chair frame, it can connect each tube to the intermediate connecting device, so that the foldable chair is more stable.

In order to achieve the above object, the technical scheme according to the present disclosure is: a foldable chair frame, comprising:

an intermediate connecting device comprising a main body, a block, a first rotating piece and a second rotating piece; the block being provided in an inner cavity of the main body and capable to slide up and down along the inner cavity, the first rotating piece and the second rotating piece being pivoted in an opening groove of the main body and capable to rotate around a pivot point;

a plurality of leg tubes pivoted to a periphery of the intermediate connecting device through the first rotating piece, and capable to be unfolded downward relative to the intermediate connecting device to form support for the intermediate connecting device, or capable to be folded upward relative to the intermediate connecting device to be stored together;

a plurality of front seat tubes and backrest tubes, the front seat tubes and backrest tubes being pivoted to the periphery of the intermediate connecting device through the second rotating piece, and capable to be expanded upward relative to the intermediate connecting device to form support for a seat cushion, or capable to be folded upward relative to the intermediate connecting device to be stored together.

In a further improvement, each of peripheries of the first rotating piece and the second rotating piece comprises a planar section and an arc section that are connected to each other; when the chair frame is folded, the block is pushed upward, the leg tubes, the front seat tubes and backrest tubes are rotated upwards such that the arc sections on the first rotating piece and the second rotating piece block the block, and tubes fail to be rotated after folding; when the chair frame is unfolded, the leg tubes, the front seat tubes and the backrest tubes are rotated downward till the planar sections of the first rotating piece and the second rotating piece are parallel to a side of the block at a same time, and the block slides down, such that the planar sections on the first rotating piece and the second rotating piece fit the side of the block at the same time.

In a further improvement, the intermediate connecting device further comprises a button and a spring; the button is inserted into a button groove of the main body from bottom to top and capable to slide relative to the button groove; the button and the block are fixedly connected, the spring is provided between the button and the button groove; when the chair frame is folded, the button is pressed and the spring is compressed, such that the block slides upward along the inner cavity; when the chair frame is unfolded, a deformation of the spring is recovered, such that the button is popped out, and at the same time the block is driven to slide downward.

In a further improvement, the first rotating piece is provided with a first convex surface and a first concave surface at an inner side, and the second rotating piece is provided with a second convex surface and a second concave surface at an inner side; the first convex surface is matched with the second concave surface, and the second convex surface is matched with the first concave surface, such that the first rotating piece and the second rotating piece are connected to each other and pivoted in the opening groove of the main body; the arc sections of the first rotating piece and the second rotating piece are respectively fixed with a first extending post and a second extending post, the first extending post is provided in each of the leg tubes, and the second extending post is respectively provided in each of the front seat tubes and backrest tubes. The extending posts are adopted to connect the leg tubes, such that the operation and the installation are easy.

In a preferred improvement, the arc sections of the first rotating piece and the second rotating piece are provided with convex point; when the first rotating piece and the second rotating piece are rotated for a certain angle, the convex point abut against a lower end of the main body, such that rotation angles of the first rotating piece and the second rotating piece is limited.

In a preferred improvement, the block is provided with a counterbore at an upper end, and a groove body at a lower end; the button is provided with a convex column, and the groove body is sleeved on the convex column; the convex column is provided with a screw hole at an upper end, and a screw is screwed into the screw hole at the upper end of the convex column after passing through the counterbore, such that the block is fixedly connected with the button; the main body is provided with a hole at an upper end, the screw passes through the hole.

In a preferred improvement, each of the backrest tubes is provided with a first backrest extension tube and a second backrest extension tube; an outer diameter of the first backrest extension tube is smaller than an inner diameter of the each of the backrest tubes, an outer diameter of the second backrest extension tube is smaller than an inner diameter of the first backrest extension tube.

In a preferred improvement, the first backrest extension tube is provided with a marble at one end, the backrest tube is provided with a limit hole at an upper end, when an extension length of the first backrest extension tube reaches a limit, the marble snaps into the limit hole; the second backrest extension tube is provided with a marble at one end, and the first backrest extension tube is provided with a limit hole at an upper end, when the extension length of the second backrest extension tube reaches a limit, the marble snaps into the limit hole. The structure is simple and can reduce the volume after folded.

In a preferred improvement, each of the front seat tubes is provided with a front seat extension tube, and an outer diameter of the front seat extension tube is smaller than an inner diameter of the front seat tube.

In a preferred improvement, the front seat extension tube is provided with a marble at one end, the front seat tube is provided with a limit hole at one end; when an extension length of the front seat extension tube reaches a limit, the marble snaps into the limit hole.

The present disclosure adopts the first rotating piece and the second rotating piece to connect the leg tubes, the front seat tubes, and the backrest tubes to the main body, wherein the first rotating piece and the second rotating piece are provided with planar sections and arc sections that are connected. When the foldable chair is folded, the button is pressed, so that the arc section is stuck on the block of the inner cavity of the main body, which can realize rapid folding; when the foldable chair is unfolded, the button pops out, and the planar sections fit the side of the block in the main body. On the other hand, convex point are provided at the parts where the first rotating piece and the second rotating piece are in contact with the main body, so as to limit the rotation angle of the rotating parts and make the tubes more stable.

DESCRIPTION OF EMBODIMENTS

The present disclosure will be further described in detail below in conjunction with the accompanying drawings and specific embodiments.

Figure 1:
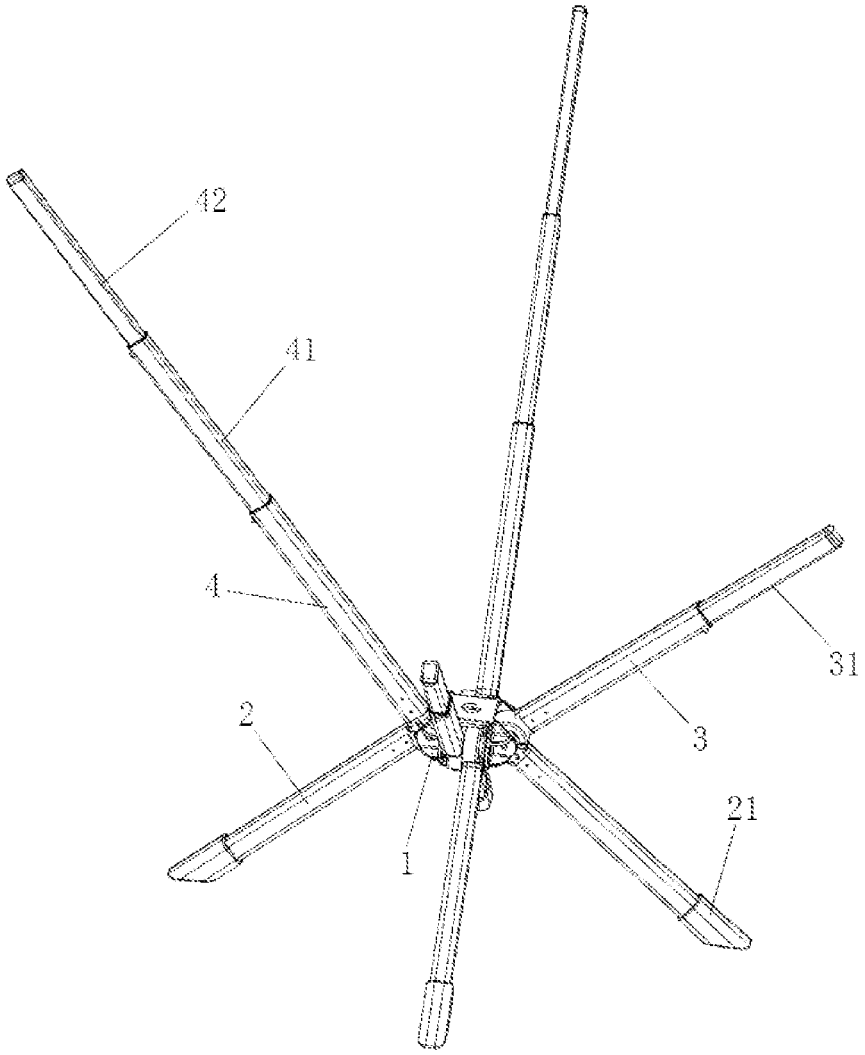
FIG. 1 is a schematic diagram of an embodiment according to the present disclosure when unfolded.
Figure 2:
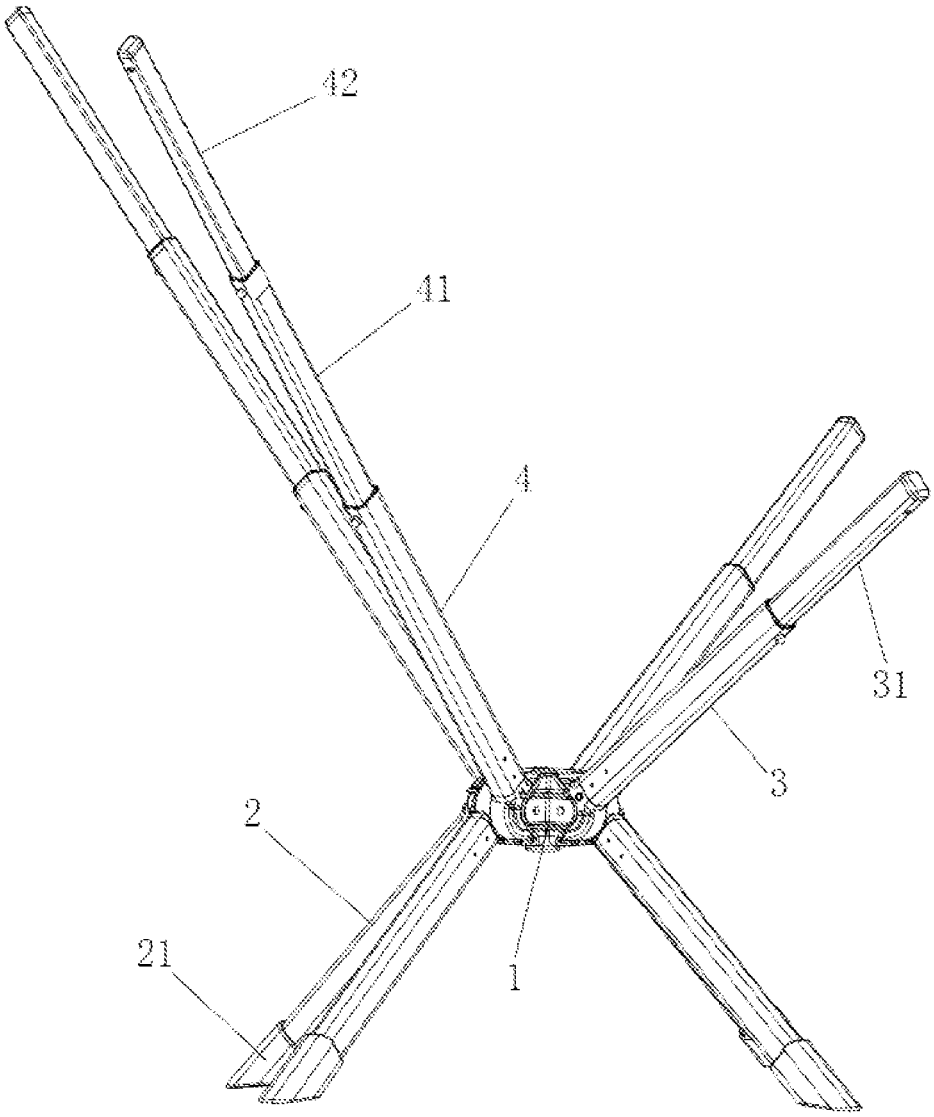
FIG. 2 is a schematic diagram of an embodiment according to the present disclosure when unfolded from another angle.
Figure 3:
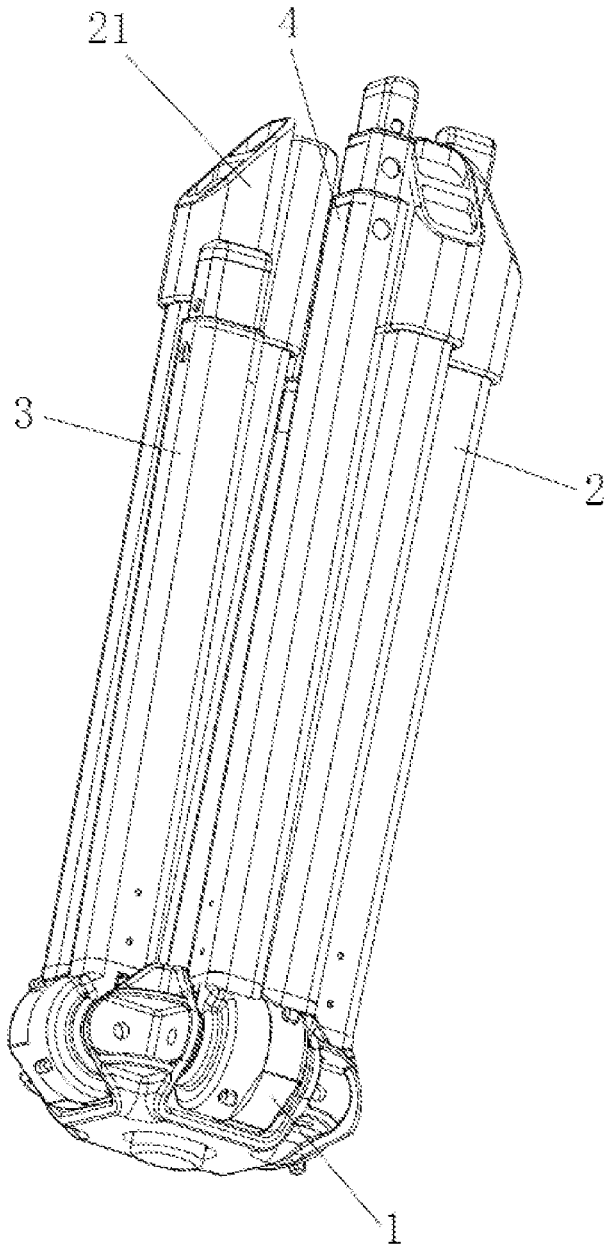
FIG. 3 is a schematic diagram of an embodiment according to the present disclosure when folded.
Figure 4:
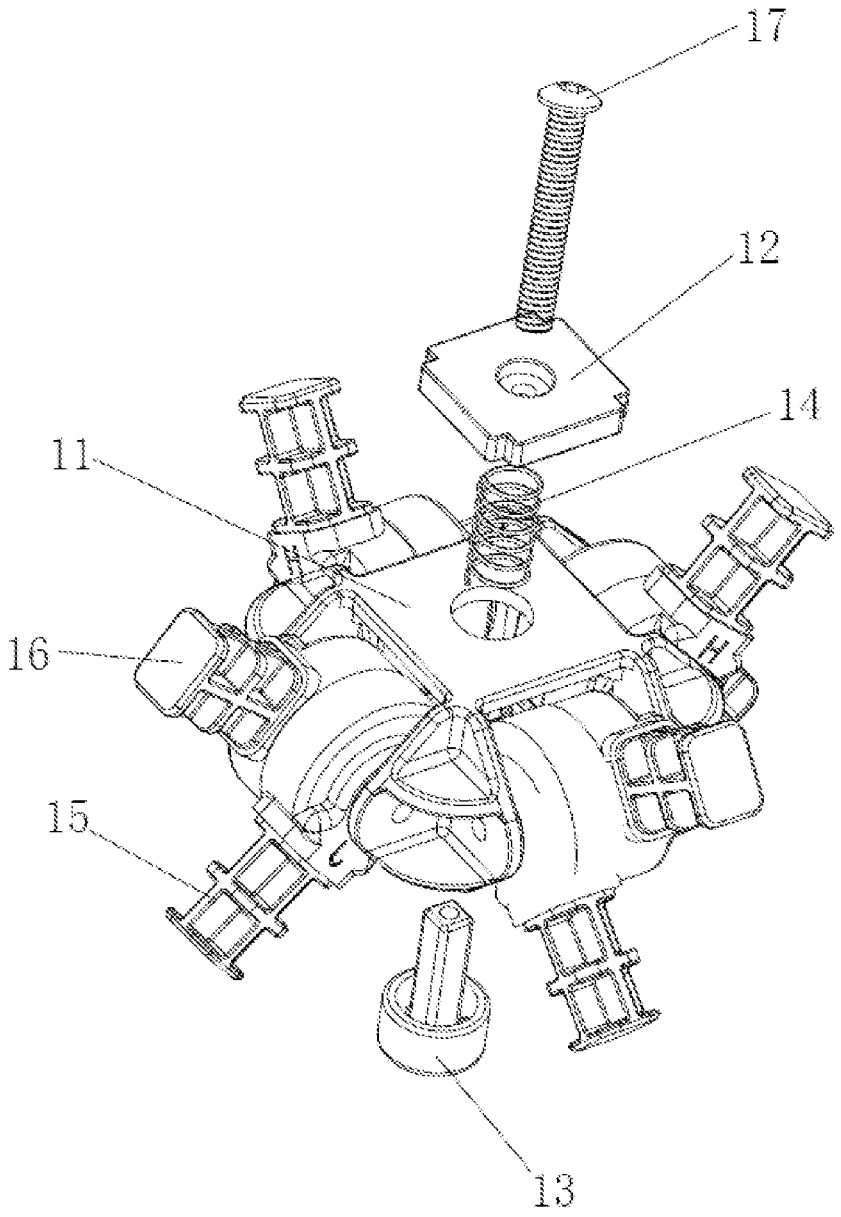
FIG. 4 is an exploded view of an intermediate connecting device according to the present disclosure.
Figure 5:
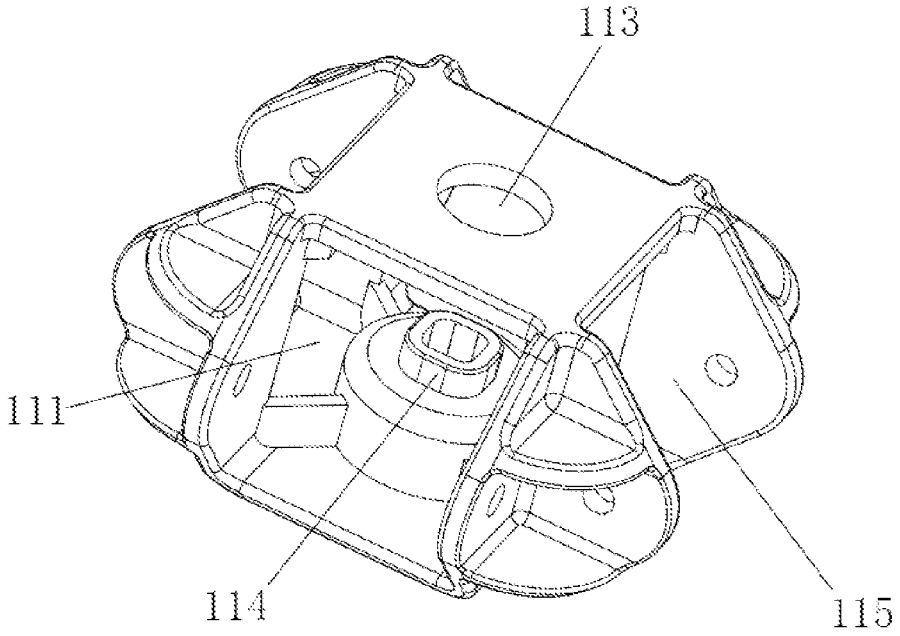
FIG. 5 is a schematic diagram of a main body according to the present disclosure.

As shown in FIGS. 1 to 2, a foldable chair frame includes:

an intermediate connecting device 1. As shown in FIG. 3, the intermediate connecting device 1 includes a main body 11, a block 12, a button 13, a spring 14, a first rotating piece 15, and a second rotating piece 16. The block 12 is provided in the inner cavity 111 of the main body 11, and can slide up and down along the inner cavity 111. The button 13 may be inserted into the button groove 112 at the lower end of the main body 11 from bottom to top and can slide relative to the button groove 112. The block 12 may have a square structure, the upper end may be provided with a counterbore, the lower end may be provided with a groove body 121, the button 13 may be provided with a convex column 131, and the groove body 121 may be sleeved on the convex column 131. The upper end of the convex column 131 may be provided with screw holes, screws 17 may be screwed into the screw holes on the upper end of the convex column 131 after passing through the counterbore, so that the block 12 and the button 13 are fixedly connected. As shown in FIG. 4 and FIG. 5, the upper end of the main body 11 may be provided with a hole 113 for the screw 17 to pass through, and a convex ring 114 may be provided at the bottom of the inner cavity 111 of the main body 11, and the button 13 passes through the convex ring 114 and is sleeved on the groove body 121 on the block 12. The outer periphery of the main body 11 may be provided with an opening groove 115, and the two sides of the opening groove 115 may be provided with holes for pivoting. The spring 14 may be provided between the button 13 and the button groove 112. The first rotating piece 15 and the second rotating piece 16 may be pivoted in the opening groove 115 of the main body 11 and can rotate around the pivot point;

four leg tubes 2, the leg tubes 2 may be pivoted to the periphery of the intermediate connecting device 1 through the first rotating piece 15 and can be unfolded downward relative to the intermediate connecting device 1 to form support for the intermediate connecting device 1 or be folded upward relative to the intermediate connecting device 1 for storing together, and the lower end of each of the leg tubes 2 may be provided with a foot cover 21;

two front seat tubes 3 and two backrest tubes 4, the front seat tubes 3 and the backrest tubes 4 may be pivoted to the periphery of the intermediate connecting device 1 through the second rotating piece 16 and can be unfolded upward relative to the intermediate connecting device 1 to form support for the seat cushion, or can be folded upward relative to the intermediate connecting device 1 for storing together.

Figure 6:
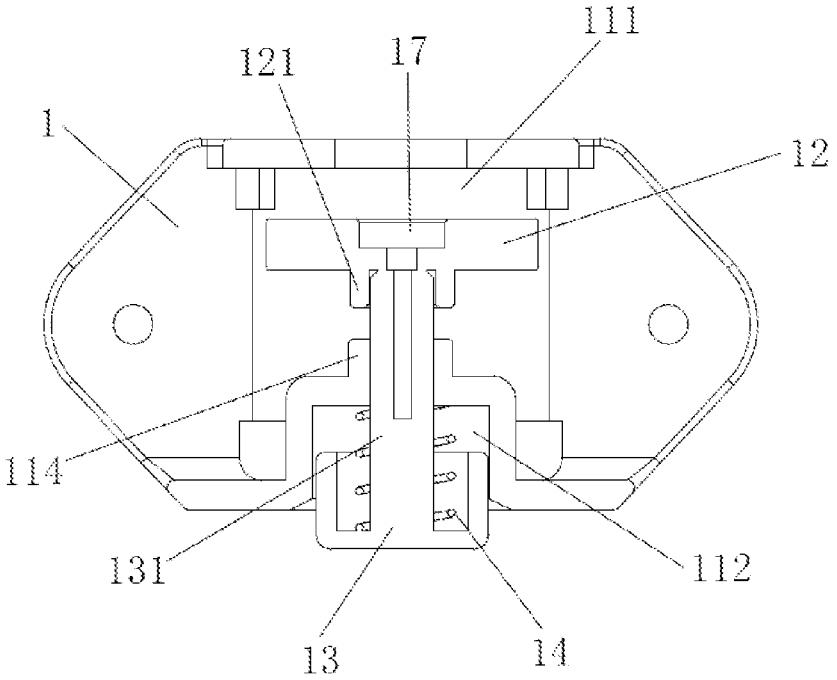
FIG. 6 is a sectional view of the main body according to the present disclosure.
Figure 7:
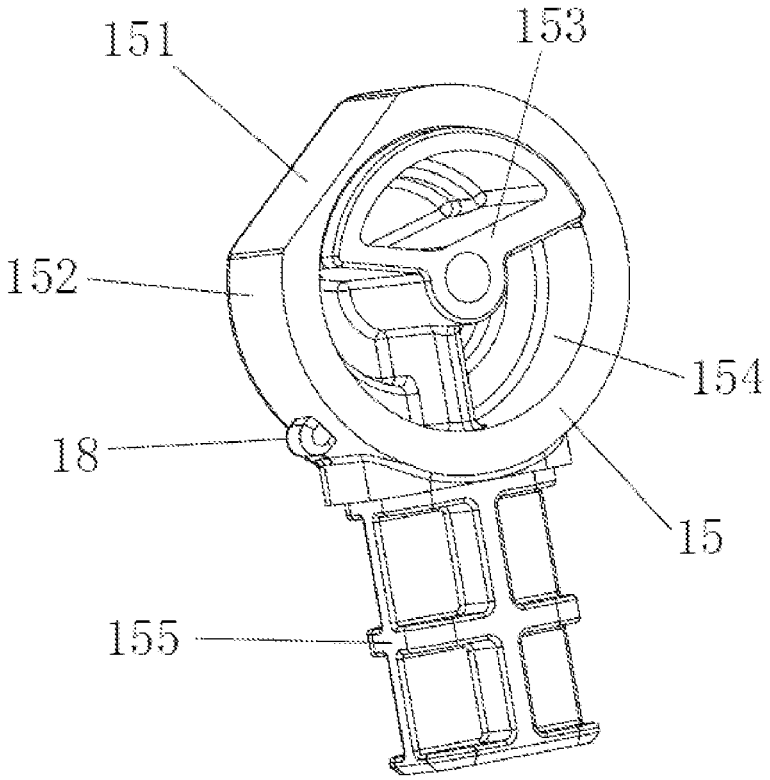
FIG. 7 is a schematic diagram of a first rotating piece according to the present disclosure.

As shown in FIG. 6 and FIG. 7, the periphery of the first rotating piece 15 may include a planar section 151 and an arc section 152 that is connected, and the periphery of the second rotating piece 16 may include a planar section 161 and an arc section 162. The side surface may be provided with a first convex surface 153 and a first concave surface 154, and the inner side of the second rotating piece 16 may be provided with a second convex surface 163 and a second concave surface 164. The first convex surface 153 is matched with the second concave surface 164, and the second convex surface 163 is matched with the first concave surface 154, so that the first rotating piece 15 and the second rotating piece 16 are connected to each other and pivoted in the opening groove 115 of the main body 11. A convex point 18 may be provided on the arc sections of the first rotating piece 15 and the second rotating piece 16. When the first rotating piece 15 and the second rotating piece 16 are rotated at a certain angle, the convex point 18 abuts against the lower end of the main body 11, thereby restricting the rotation angle of the first rotating piece 15 and the second rotating piece 16.

The arc sections of the first rotating piece 15 and the second rotating piece 16 may be respectively fixed with a first extending post 155 and a second extending post 165. The first extending post 155 may be provided in the leg tube 2, and the second extending post 165 may be respectively provided in the front seat tube 3 and the backrest tube 4.

As shown in FIG. 1, the backrest tube 4 may be provided with a first backrest extension tube 41 and a second backrest extension tube 42. The outer diameter of the first backrest extension tube 41 may be smaller than the inner diameter of the backrest tube 4, and the outer diameter of the second backrest extension tube 42 may be smaller than the inner diameter of the first backrest extension tube 41. The end of the first backrest extension tube 41 may be provided with a marble, and the upper end of the backrest tube 4 may be provided with a limit hole. When the extension length of the first backrest extension tube 41 reaches the limit, the marble may snap into the limit hole. The end of the second backrest extension tube 42 may be provided with a marble, and the upper end of the first backrest extension tube 41 may be provided with a limit hole, and when the extended length of the second backrest extension tube 42 reaches the limit, the marble may snap into the limit hole.

The front seat tube 3 may be provided with a front seat extension tube 31, and the outer diameter of the front seat extension tube 31 may be smaller than the inner diameter of the front seat tube 3. The end of the front seat extension tube 31 may be provided with a marble, and the end of the front seat tube 3 may be provided with a limit hole. When the extension length of the front seat extension tube 31 reaches the limit, the marble may snap into the limit hole.

Figure 8:
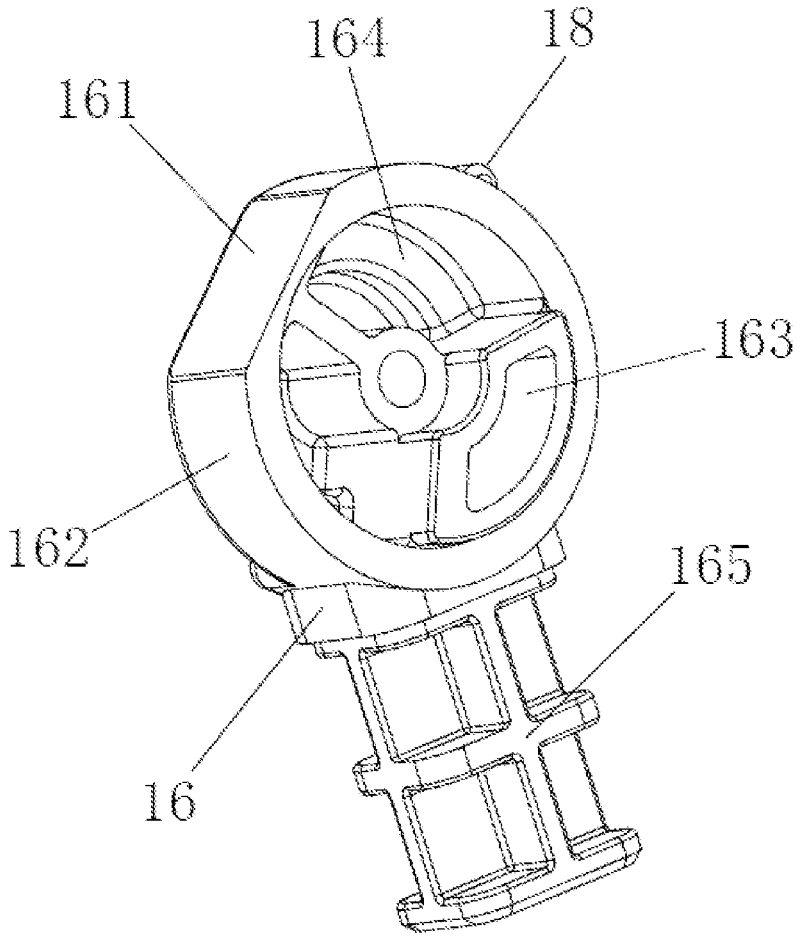
FIG. 8 is a schematic diagram of a second rotating piece according to the present disclosure.
Figure 9:
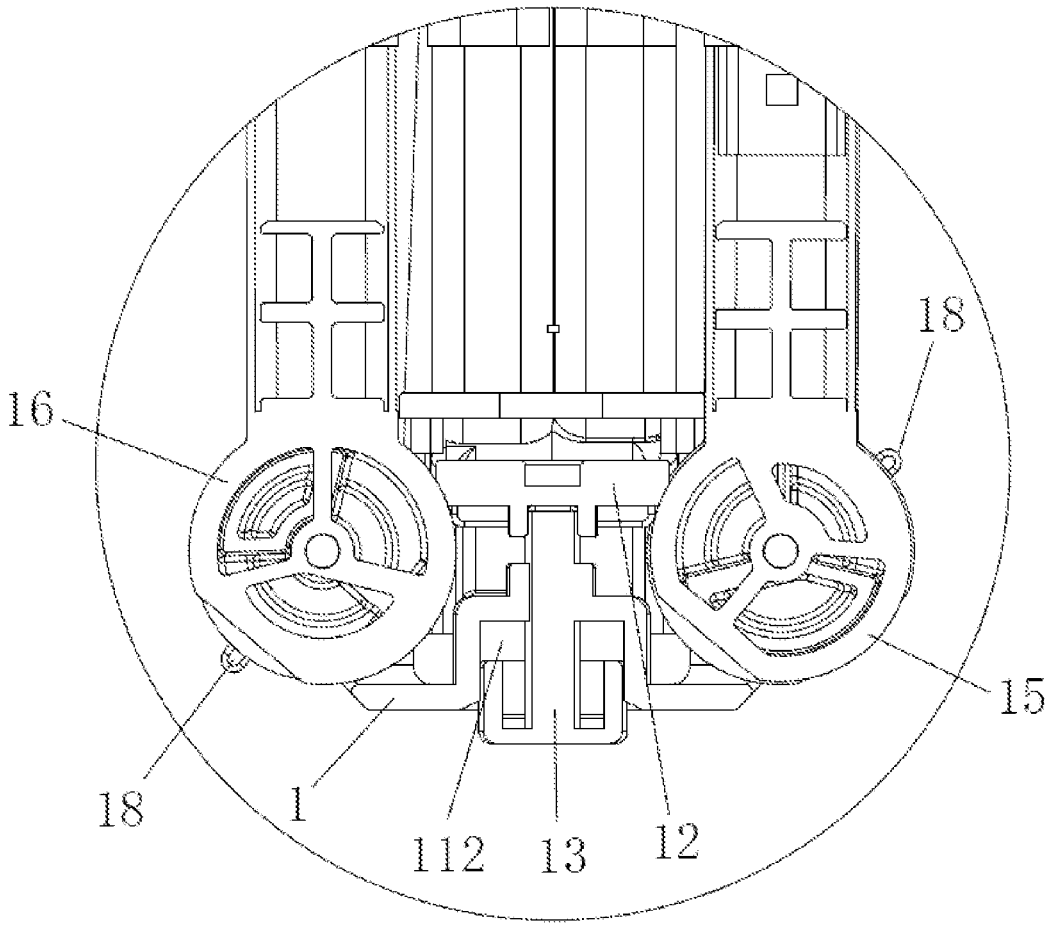
FIG. 9 is a partial cross-sectional view of an embodiment according to the present disclosure when folded.
Figure 10:
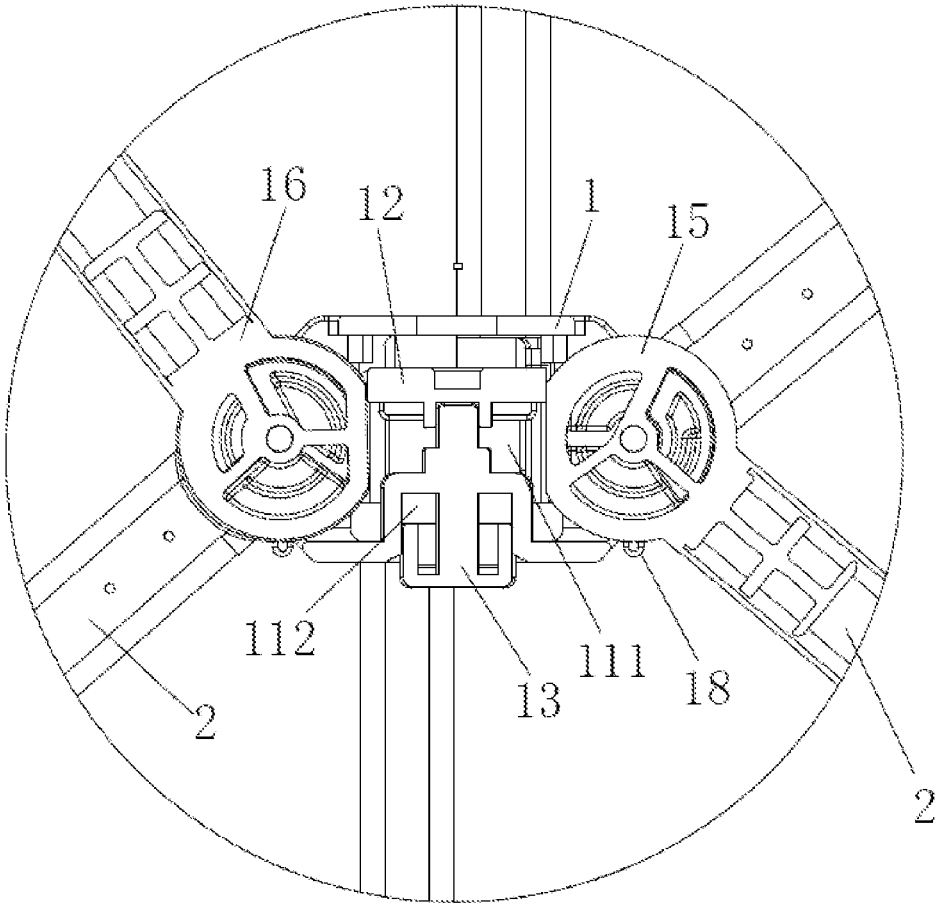
FIG. 10 is a partial cross-sectional view of an embodiment according to the present disclosure when unfolded.

As shown in FIG. 8, when the chair frame is folded, the button 13 is pressed upward to make it slide up along the button groove 112 while compressing the spring 14, so that the block 12 slides up along the inner cavity 111. The leg tubes 2, the front seat tubes 3 and the backrest tubes 4 are rotated upward, such that the arc sections on the first rotating piece 15 and the second rotating piece 16 may be blocked by the block 12, and the tube can no longer be rotated after folding, thereby realizing rapid folding. As shown in FIG. 9, when the chair frame is unfolded, and when the leg tubes 2, the front seat tubes 3 and the backrest tubes 4 may be rotated downward till the planar sections on the first rotating piece 15 and the second rotating piece 16 are parallel to the side of the block 12, the compressed spring 14 bounces the button 13, and drives the block 12 to slide downward at the same time, so that the planar sections on the first rotating piece 15 and the second rotating piece 16 are in contact with the side of the block 12 at the same time.

The above is only a preferred embodiment according to the present disclosure, and those skilled in the art can make equivalent changes according to the claims, which all fall into the protection scope of the present disclosure.

What is claimed is:

1. A foldable chair frame, comprising:

an intermediate connecting device comprising a main body, a block, a first rotating piece and a second rotating piece, the block being provided in an inner cavity of the main body and configured to slide up and down along the inner cavity, the first rotating piece and the second rotating piece being pivoted in an opening groove of the main body and configured to rotate around a pivot point;

a plurality of leg tubes pivotally coupled to a periphery of the intermediate connecting device through the first rotating piece, the leg tubes being configured to be unfolded downward relative to the intermediate connecting device to form a support for the intermediate connecting device and configured to be folded upward relative to the intermediate connecting device to be stored together; and a plurality of front seat tubes and backrest tubes, the front seat tubes and the backrest tubes being pivoted to the periphery of the intermediate connecting device through the second rotating piece, the front seat tubes and the backrest tubes being configured to be expanded upward relative to the intermediate connecting device to form a support for a seat cushion and configured to be folded upward relative to the intermediate connecting device to be stored together, wherein:

the intermediate connecting device further comprises a button and a spring, the button is inserted into a button groove of the main body from bottom to top and configured to slide relative to the button groove, the button and the block are fixedly connected, the spring is provided between the button and the button groove, when the foldable chair frame is folded, the button is pressed and the spring is compressed, such that the block slides upward along the inner cavity, and when the foldable chair frame is unfolded, a deformation of the spring is recovered, such that the button is popped out, and at the same time the block is driven to slide downward.

2. The foldable chair frame according to claim 1, wherein:

each of peripheries of the first rotating piece and the second rotating piece comprises a planar section and an arc section that are connected to each other, when the foldable chair frame is folded, the block is pushed upward, the leg tubes, the front seat tubes, and the backrest tubes are rotated upwards such that the arc sections on the first rotating piece and the second rotating piece block the block, and the leg tubes, the front seat tubes, and the backrest tubes are inhibited from rotating after folding, and when the foldable chair frame is unfolded, the leg tubes, the front seat tubes, and the backrest tubes are rotated downward until the planar sections of the first rotating piece and the second rotating piece are parallel to a side of the block at a same time and the block slides down, such that the planar sections of the first rotating piece and the second rotating piece fit the side of the block at the same time.

3. The foldable chair frame according to claim 2, wherein:

the arc sections of the first rotating piece and the second rotating piece are provided with a convex point, and when the first rotating piece and the second rotating piece are rotated for a certain angle, the convex point abuts a lower end of the main body, such that rotation angles of the first rotating piece and the second rotating piece are limited.

4. The foldable chair frame according to claim 2, wherein:

the first rotating piece is provided with a first convex surface and a first concave surface at an inner side of the first rotating piece, the second rotating piece is provided with a second convex surface and a second concave surface at an inner side of the second rotating piece, the first convex surface is matched with the second concave surface and the second convex surface is matched with the first concave surface, such that the first rotating piece and the second rotating piece are connected to each other and pivoted in the opening groove of the main body, the arc sections of the first rotating piece and the second rotating piece are respectively fixed with a first extending post and a second extending post, the first extending post is provided in each of the leg tubes, and the second extending post is respectively provided in each of the front seat tubes and the backrest tubes.

5. The foldable chair frame according to claim 1, wherein:

the first rotating piece is provided with a first convex surface and a first concave surface at an inner side of the first rotating piece, the second rotating piece is provided with a second convex surface and a second concave surface at an inner side of the second rotating piece, the first convex surface is matched with the second concave surface and the second convex surface is matched with the first concave surface, such that the first rotating piece and the second rotating piece are connected to each other and pivoted in the opening groove of the main body, arc sections of the first rotating piece and the second rotating piece are respectively fixed with a first extending post and a second extending post, the first extending post is provided in each of the leg tubes, and the second extending post is respectively provided in each of the front seat tubes and the backrest tubes.

6. The foldable chair frame according to claim 1, wherein:

the block is provided with a counterbore at an upper end and a groove body at a lower end, the button is provided with a convex column, the groove body is sleeved on the convex column, the convex column is provided with a screw hole at an upper end, a screw is screwed into the screw hole at the upper end of the convex column after passing through the counterbore, such that the block is fixedly connected with the button, the main body is provided with a hole at an upper end, and the screw passes through the hole.

7. The foldable chair frame according to claim 1, wherein:

each of the backrest tubes is provided with a first backrest extension tube and a second backrest extension tube, an outer diameter of the first backrest extension tube is smaller than an inner diameter of the each of the backrest tubes, and an outer diameter of the second backrest extension tube is smaller than an inner diameter of the first backrest extension tube.

8. The foldable chair frame according to claim 7, wherein:

the first backrest extension tube is provided with a marble at one end, the each of the backrest tubes is provided with a limit hole at an upper end, when an extension length of the first backrest extension tube reaches a limit, the marble snaps into the limit hole, the second backrest extension tube is provided with a second marble at one end, the first backrest extension tube is provided with a second limit hole at an upper end, and when an extension length of the second backrest extension tube reaches a limit, the second marble snaps into the second limit hole.

9. The foldable chair frame according to claim 1, wherein:

each of the front seat tubes is provided with a front seat extension tube, and an outer diameter of the front seat extension tube is smaller than an inner diameter of the front seat tube.

10. The foldable chair frame according to claim 9, wherein:

the front seat extension tube is provided with a marble at one end, the each of the front seat tubes is provided with a limit hole at one end, and when an extension length of the front seat extension tube reaches a limit, the marble snaps into the limit hole.

11. A foldable chair frame, comprising:

an intermediate connecting device comprising a main body, a block, a first rotating piece and a second rotating piece, the block being provided in an inner cavity of the main body and configured to slide up and down along the inner cavity, the first rotating piece and the second rotating piece being pivoted in an opening groove of the main body and configured to rotate around a pivot point;

a plurality of leg tubes pivotally coupled to a periphery of the intermediate connecting device through the first rotating piece, the leg tubes being configured to be unfolded downward relative to the intermediate connecting device to form a support for the intermediate connecting device and configured to be folded upward relative to the intermediate connecting device to be stored together; and a plurality of front seat tubes and backrest tubes, the front seat tubes and the backrest tubes being pivoted to the periphery of the intermediate connecting device through the second rotating piece, the front seat tubes and the backrest tubes being configured to be expanded upward relative to the intermediate connecting device to form a support for a seat cushion and configured to be folded upward relative to the intermediate connecting device to be stored together, wherein:

each of peripheries of the first rotating piece and the second rotating piece comprises a planar section and an arc section that are connected to each other, when the foldable chair frame is folded, the block is pushed upward, the leg tubes, the front seat tubes, and the backrest tubes are rotated upwards such that the arc sections on the first rotating piece and the second rotating piece block the block, and the leg tubes, the front seat tubes, and the backrest tubes are inhibited from rotating after folding, and when the foldable chair frame is unfolded, the leg tubes, the front seat tubes, and the backrest tubes are rotated downward until the planar sections of the first rotating piece and the second rotating piece are parallel to a side of the block at a same time and the block slides down, such that the planar sections of the first rotating piece and the second rotating piece fit the side of the block at the same time.

12. The foldable chair frame according to claim 11, wherein:

the arc sections of the first rotating piece and the second rotating piece are provided with a convex point, and when the first rotating piece and the second rotating piece are rotated for a certain angle, the convex point abuts a lower end of the main body, such that rotation angles of the first rotating piece and the second rotating piece are limited.

13. The foldable chair frame according to claim 11, wherein:

each of the backrest tubes is provided with a first backrest extension tube and a second backrest extension tube, an outer diameter of the first backrest extension tube is smaller than an inner diameter of the each of the backrest tubes, and an outer diameter of the second backrest extension tube is smaller than an inner diameter of the first backrest extension tube.

14. The foldable chair frame according to claim 13, wherein:

the first backrest extension tube is provided with a marble at one end, the each of the backrest tubes is provided with a limit hole at an upper end, when an extension length of the first backrest extension tube reaches a limit, the marble snaps into the limit hole, the second backrest extension tube is provided with a second marble at one end, the first backrest extension tube is provided with a second limit hole at an upper end, and when an extension length of the second backrest extension tube reaches a limit, the second marble snaps into the second limit hole.

15. The foldable chair frame according to claim 11, wherein:

each of the front seat tubes is provided with a front seat extension tube, and an outer diameter of the front seat extension tube is smaller than an inner diameter of the front seat tube.

16. The foldable chair frame according to claim 15, wherein:

the front seat extension tube is provided with a marble at one end, the each of the front seat tubes is provided with a limit hole at one end, and when an extension length of the front seat extension tube reaches a limit, the marble snaps into the limit hole.

17. The foldable chair frame according to claim 11, wherein:

the first rotating piece is provided with a first convex surface and a first concave surface at an inner side of the first rotating piece, the second rotating piece is provided with a second convex surface and a second concave surface at an inner side of the second rotating piece, the first convex surface is matched with the second concave surface and the second convex surface is matched with the first concave surface, such that the first rotating piece and the second rotating piece are connected to each other and pivoted in the opening groove of the main body, the arc sections of the first rotating piece and the second rotating piece are respectively fixed with a first extending post and a second extending post, the first extending post is provided in each of the leg tubes, and the second extending post is respectively provided in each of the front seat tubes and the backrest tubes.

18. A foldable chair frame, comprising:

an intermediate connecting device comprising a main body, a block, a first rotating piece and a second rotating piece, the block being provided in an inner cavity of the main body and configured to slide up and down along the inner cavity, the first rotating piece and the second rotating piece being pivoted in an opening groove of the main body and configured to rotate around a pivot point;

a plurality of leg tubes pivotally coupled to a periphery of the intermediate connecting device through the first rotating piece, the leg tubes being configured to be unfolded downward relative to the intermediate connecting device to form a support for the intermediate connecting device and configured to be folded upward relative to the intermediate connecting device to be stored together; and a plurality of front seat tubes and backrest tubes, the front seat tubes and the backrest tubes being pivoted to the periphery of the intermediate connecting device through the second rotating piece, the front seat tubes and the backrest tubes being configured to be expanded upward relative to the intermediate connecting device to form a support for a seat cushion and configured to be folded upward relative to the intermediate connecting device to be stored together, wherein:

the first rotating piece is provided with a first convex surface and a first concave surface at an inner side of the first rotating piece, the second rotating piece is provided with a second convex surface and a second concave surface at an inner side of the second rotating piece, the first convex surface is matched with the second concave surface and the second convex surface is matched with the first concave surface, such that the first rotating piece and the second rotating piece are connected to each other and pivoted in the opening groove of the main body, arc sections of the first rotating piece and the second rotating piece are respectively fixed with a first extending post and a second extending post, the first extending post is provided in each of the leg tubes, and the second extending post is respectively provided in each of the front seat tubes and the backrest tubes.

19. The foldable chair frame according to claim 18, wherein:

each of the backrest tubes is provided with a first backrest extension tube and a second backrest extension tube, an outer diameter of the first backrest extension tube is smaller than an inner diameter of the each of the backrest tubes, and an outer diameter of the second backrest extension tube is smaller than an inner diameter of the first backrest extension tube.

20. The foldable chair frame according to claim 19, wherein:

the first backrest extension tube is provided with a marble at one end, the each of the backrest tubes is provided with a limit hole at an upper end, when an extension length of the first backrest extension tube reaches a limit, the marble snaps into the limit hole, the second backrest extension tube is provided with a second marble at one end, the first backrest extension tube is provided with a second limit hole at an upper end, and when an extension length of the second backrest extension tube reaches a limit, the second marble snaps into the second limit hole.

* * * * *